US005853362A

United States Patent [19]

Jacobs

[11] Patent Number: 5,853,362

[45] Date of Patent: Dec. 29, 1998

[54] GLANDULAR STIMULATOR DEVICE AND METHOD

[76] Inventor: Deborah A. Jacobs, 569 Congo St., San Francisco, Calif. 94131

[21] Appl. No.: 884,375

[22] Filed: Jun. 28, 1997

[51] Int. Cl.[6] ..... A61H 21/00

[52] U.S. Cl. ..... 600/38

[58] Field of Search ..... 128/831–841, 128/845; 600/38–41

[56] References Cited

U.S. PATENT DOCUMENTS

| | | | |
|---|---|---|---|
| D. 270,280 | 8/1983 | Epstein | 24/41 D |
| 2,342,557 | 7/1944 | Ross et al. . | |
| 2,478,786 | 8/1949 | Smallen . | |
| 3,502,328 | 3/1970 | Hamilton | 272/80 |
| 3,996,930 | 12/1976 | Sekulich . | |
| 4,002,164 | 1/1977 | Bradley . | |
| 4,050,449 | 9/1977 | Castellana et al. . | |
| 4,241,912 | 12/1980 | Mercer et al. | 272/125 |
| 4,574,791 | 3/1986 | Mitchener . | |
| 5,690,603 | 11/1997 | Kain | 600/38 |

OTHER PUBLICATIONS 1997 (summer) Good Vibrations, see ESP. pp. 3,10,16 Catalog.

1997 (summer) Xandria Collection, see ESP pp. 19,21,48 Catalog.

*Primary Examiner*—John P. Lacyk
*Assistant Examiner*—Samuel Gilbert
*Attorney, Agent, or Firm*—John S. Heyman

[57] ABSTRACT

An intravaginal glandular stimulator device is sized and shaped to be worn internally by a woman. That is, a predetermined hook shaped device constructed of sufficiently rigid material is provided so that the proximal end (52*j*) of the device rests in a vaginal subcavity (74*f*1) adjacent to the woman's Grafenberg Spot (71*f*1). The proximal end (52*j*) is shaped and angled to exert pressure against the Grafenberg Spot (71*f*1), and to resist dislodgement except by conscious muscular relaxation and manual pulling. The stimulator's extravaginal or distal end (50*j*) may be shaped like a dildo to be used for vaginally or anally penetrating a partner; shaped recumbently upon itself and used to stimulate the external genitalia of the wearer; or shaped as a handle to be manipulated by the wearer or by her partner. The proximal end (52*j*) may extend into the vaginal cavity beyond the embedding hook (53*j*) which lodges in the Grafenberg spot (71*f*1), and thus function additionally as a dildo. The shape and function of the proximal end (52*j*) may be duplicated on the distal end (50*j*) to provide a female partner with Grafenberg spot stimulation. The stimulator provides an easy-to-affix shape for sexual stimulation of the wearer without the necessity of straps, buckles, or the like; and provides a predetermined hook curvature for genital-to-genital sexual contact between two female partners in positions not otherwise possible. It further allows for simultaneous Grafenberg spot and prostate gland stimulation for a heterosexual couple.

11 Claims, 8 Drawing Sheets

GLANDULAR STIMULATOR DEVICE AND METHOD

BACKGROUND—FIELD OF INVENTION

This invention relates to articles which enhance sexual functioning and pleasure, specifically to such articles which are inserted into the vagina and/or anus.

BACKGROUND—DISCUSSION OF PRIOR ART

Among items commercially available for enhancing sexual functioning are dildos, vaginal exercise bars, and prostate stimulators. These items are made of a variety of materials, including silicone, plastic, wood, and metal, and are generally elongate and cylindrical in shape. Their length, width, and shape vary within anatomically prescribed limits. They may incorporate design features imitative of a wide range of natural, mechanical, and imaginary objects, e.g., vegetables such as a cucumber or ear of corn, a rocket ship, a dolphin, or the human penis or finger; or the design may be more abstract. The distal end may have a handle (which is not inserted) or other means for attachment to a stationary or moving object, or to the surface of a partner's body. In use they are inserted into the vagina or anus, either by an individual or by a partner, using suitable lubrication as required. They provide stimulation from friction upon manipulation of the object, or by pressure from the distension of the cavity due to the volume of the object. Some objects are designed to create additional sensory effects in the user through the production of heat, fluid discharge, or low-voltage electrical stimulation or vibration. Some objects create diffuse sensations in the user, while others are designed to target specific areas of the body cavity, such as the prostate gland in men or the paraurethral gland of the urethral sponge of the clitoris in women (also called the Grafenberg spot or G spot), or they may have surface texture, such as raised bumps or ridges which enhance local pressures upon manipulation of the object.

Dildos and the related items described above are used by individuals of either sex, by transgendered (sex-changed) persons, and by couples (both heterosexual and homosexual) to give sexual pleasure to each other, either in lieu of or in addition to vaginal/penile or other modes of sexual congress. Hence, such couples may be comprised of two women, a man and a woman, two men, two transgendered persons, or a transgendered person and either a man or a woman. In addition to their use for pleasure, the use of items such as vaginal exercise bars and prostate stimulators may be recommended by physicians and other health professionals for the purpose of developing, strengthening, tightening, or otherwise enhancing the function of muscles, glands, and other organs surrounding the vagina and/or urethra and/or anus. Conditions in which such use may be recommended include post-partum vaginal recovery, prostatitis, multiple sclerosis, anorgasmia, and urinary incontinence. The use of these objects may also be recommended for purposes such as contraception, avoidance of disease (including AIDS), disability, erectile dysfunction, and temporary fatigue.

When a dildo with a handle or other protuberance at the distal end, such as a flared base, is held in the hand by a user or the user's partner, the holder is inconvenienced and may be constrained from sexual activity, other than manipulating the dildo, by the necessary positioning of his or her body relative to that of the partner. If the dildo is attached to the body surface by a strap or harness, the dildo may be manipulated by the wearer while leaving the hands free. However, this method requires the acquisition of such a strap or harness, and some skill in properly and securely affixing it to the body (generally to the pelvis, but alternatively to the arm, leg, torso, etc.), and to its effective manipulation once it is so affixed. Further, whether the wearer is male or female, little direct physical stimulation will come to the wearer from manipulating either a hand-held or harness-held dildo for a partner's enjoyment. A dildo can also be attached to an inanimate object, such as a chair. However, although such an arrangement has the advantage of being stable, the user must singlehandedly create the motion between herself or himself and the dildo, not to mention the further disadvantage of the impersonal and noninteractive nature of such an act.

The reasons a couple might choose to employ a dildo in mutual sexual activity are outlined above. However, having chosen to do so, the couple is faced with several difficulties. First, the device may be awkward to use. Second, the inanimate nature of the dildo can, on a psychological and a sensory level, create a barrier between two people when its intended purpose is to unite them in mutual pleasure. Specifically, it may be difficult for the couple to have genital-to-genital contact.

Several general approaches to this problem have achieved some success. Some pelvic-mounted dildo-plus-harness combinations include a small vibrator built in to either the shaft of the dildo or the harness where it holds the dildo to the pelvic area. If the wearer is a woman, then mutual and simultaneous pleasure may be achieved through clitoral stimulation of the wearer from the vibrations and vaginal stimulation of the penetrated person by manipulation of the dildo.

Double-ended dildos are marketed, generally for use by female couples. Although mutual and simultaneous penetration can be achieved using them, their use creates distinct problems. The primary difficulty is in putting and keeping the dildo in motion since, when the dildo is inserted simultaneously into both women's vaginas as intended, there is no convenient way to grasp and move the device. Further, if the device is too long it may be impossible for the couple to enjoy direct contact of their vulvas.

Designers of the aforementioned devices tacitly assume that, in the case of women, pleasure is primarily achieved either through external clitoral stimulation or by nonspecific vaginal stimulation by insertion and manipulation of a roughly cylindrical dildo. However, female anatomy and sexual response are more complex and subtle than this, the realization of which has led to the need for further development of a class of sexual aids, generally called G spot stimulators.

Specifically, stimulation of the Grafenberg, or G spot, leads to orgasm in many women, often accompanied by the expulsion of fluid from the vulva. The G spot is an area on the anterior wall of the vagina, about midway between the opening and the cervix (or usually about two inches in from the vaginal opening). The G spot is variously described as a paraurethral gland considered to be a female homolog of the male prostate gland, or as erectile tissue connected to the deep roots of the clitoris. The G spot may be easily stimulated with the crooked finger or fingers of a partner's hand, but it is not so directly stimulated by a cylindrical dildo, or by the human penis. This is because to not only touch but to strongly stimulate the G spot requires pressure at roughly ninety degrees to the axis of the vaginal canal and the orientation of manual or penile thrusting.

Many women recount qualitative differences between orgasms which are induced by G spot stimulation and those which are more clitoral in origin. A G spot orgasm is more likely to be described as evincing deep visceral spasmodic contractions, while a clitoral orgasm is apt to be more focused. Of course the two modes of stimulation are not mutually exclusive and the two "types " of orgasm have more similarities than differences.

An ideal sexual aid would provide general vaginal, G spot, and more direct clitoral stimulation. Mitchener (U.S. Pat. No. 4,574,791, Jul. 27, 1984) shows a gently crooked device for insertion into the vagina for the purpose of internal muscle-toning and stimulation. An attached inflatable bulb, external to the vagina, is to be manipulated by the user's or the user's partner's hand, and so the device is not suitable for either the mutual simultaneous pleasuring of the partners or for direct clitoral stimulation. Although the gentle crook of the design reaches the G spot, it does not do so at an angle sufficient to strongly press into it and thus cause effective stimulation.

Sekulich (U.S. Pat. No. 3,996,930, Dec. 14, 1976) describes a V-shaped vaginal dildo with an external leg which stimulates the clitoris. However, the internal leg is substantially straight and does not effect G spot stimulation. Further, the internal portion is not intended to be vigorously thrust in and out of the vagina in use, for such thrusting would obviate the usefulness of the external clitoral stimulator.

Epstein (U.S. Pat. No. D270,280, Aug. 23, 1983) shows a vibrator attachment with a straight cylindrical member presumably intended for insertion in the vagina or anus. A commercially-available version of this design, sold under the trademark The G Spotter, incorporates a slight crook at the end of this cylindrical member. The external portion of the device can be placed in contact with the clitoris, thus stimulating both areas simultaneously. However, the device does not facilitate direct sex with a partner. Also, the proportions of this device (i.e., short length of the cylindrical member and length and orientation of the crooked end) do not allow thrusting. And as with Mitchener (above), the gentle crook of the tubular member is not very effective in stimulating the G spot through strong lateral pressure.

Dildos and other roughly cylindrical objects intended for vaginal penetration have been used throughout human history. Some, such as Castellana et al. (U.S. Pat. No. 4,050,449, Sep. 27, 1979) and Mercer et al. (U.S. Pat. No. 4,241,912, Dec. 30, 1980) incorporate features such as an inflatable cylinder or contours for gripping which are intended to strengthen the musculature surrounding the vagina. However, their contact with and stimulation of the G spot are minor and accidental.

Some versions of commercially-available double ended dildos are crooked slightly upwards at the ends. These crooks contact the G spot obliquely upon partial insertion or during thrusting, but not with effective pressure.

Several devices have been created for the purpose of exercising both the vaginal and anal muscles (e.g., Hamilton, U.S. Pat. No. 3,502,328, Mar. 24, 1970). Their purpose is primarily for use in strengthening exercises and not for sexual gratification.

Smallen (U.S. Pat. No. 2,478,786, Aug. 9, 1949) shows a thin device for insertion in the anus of a man for the purpose of stimulating the prostate gland. The inserted section is slightly curved, and the external section extends anteriorly between the legs so that it may be grasped and manipulated by the man or his partner. The device can be used for either sexual gratification or medical massage of the prostate, but is not of direct use in facilitating sex between partners nor is it of any application as regards female penetration, either vaginal or anal. Other devices (e.g., Ross and Dare, U.S. Pat. No. 2,342,557, Feb. 22, 1944; and Bradley, U.S. Pat. No. 4,002,164, Jan. 11, 1977) have similar uses and disadvantages.

OBJECTS AND ADVANTAGES

Accordingly, several objects and advantages of the present invention are to provide an improved sexual aid and stimulator, to provide a glandular stimulation device with which a woman may easily, comfortably, and with pleasure for herself and her partner, engage in mutually penetrative sexual congress. This act also gives pleasure to the woman through intense stimulation of her G spot. It does, without the use of straps or harnesses, allows her to comfortably and firmly affix a dildo to her body, which dildo optionally allows her to penetrate her partner's vagina or anus. In the case of a female couple, it allows both penetration-with-motion of the dildo combined with vulva-to-vulva contact. In the case of a heterosexual couple, it allows simultaneous G spot and prostate gland stimulation; and allows the female wearer to engage in such penetration and contact without imitating male anatomy. Regardless of the gender of the female wearer's partner, this device allows simultaneous stimulation of both partners. Also, sexual activity with the present device encourages the rhythmic contraction and relaxation of pelvic muscles, resulting in toning and strengthening, as a beneficial side effect of the direct sexual stimulation. Muscle strength, in turn, leads to enhanced pleasure, thus initiating a positive and self-reinforcing cycle.

Thus, the present invention is unique in simultaneously attaining, in one device, many of the objects of the prior art listed above. By obviating the need for attachment means such as belts or straps, it attains an additional object by solving a problem not recognized or attempted by the prior art. In addition to its ease of use and efficacy, the present device provides a novel approach to genital-genital or anal-genital sex. A variety of options is important in fostering continued sexual interest and maintaining healthy sexual relationships, which the present device enhances.

Further objects and advantages of the present device will become apparent from a consideration of the drawings and ensuing descriptions.

DESCRIPTION OF FIGURE DRAWINGS

Figure 1:
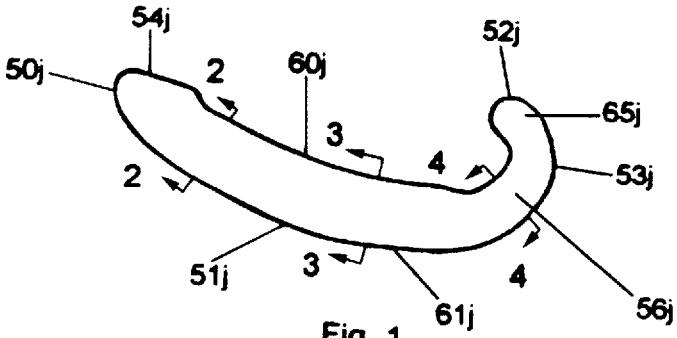
FIG. 1 is a lateral view of the preferred embodiment of a glandular stimulator according to the invention.
Figure 2:
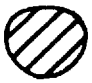
Figure 3:
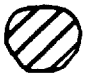
Figure 4:
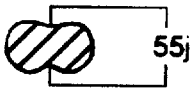

FIGS. 2, 3, and 4 are cross-sectional views of the glandular stimulator of FIG. 1.

Figure 5:
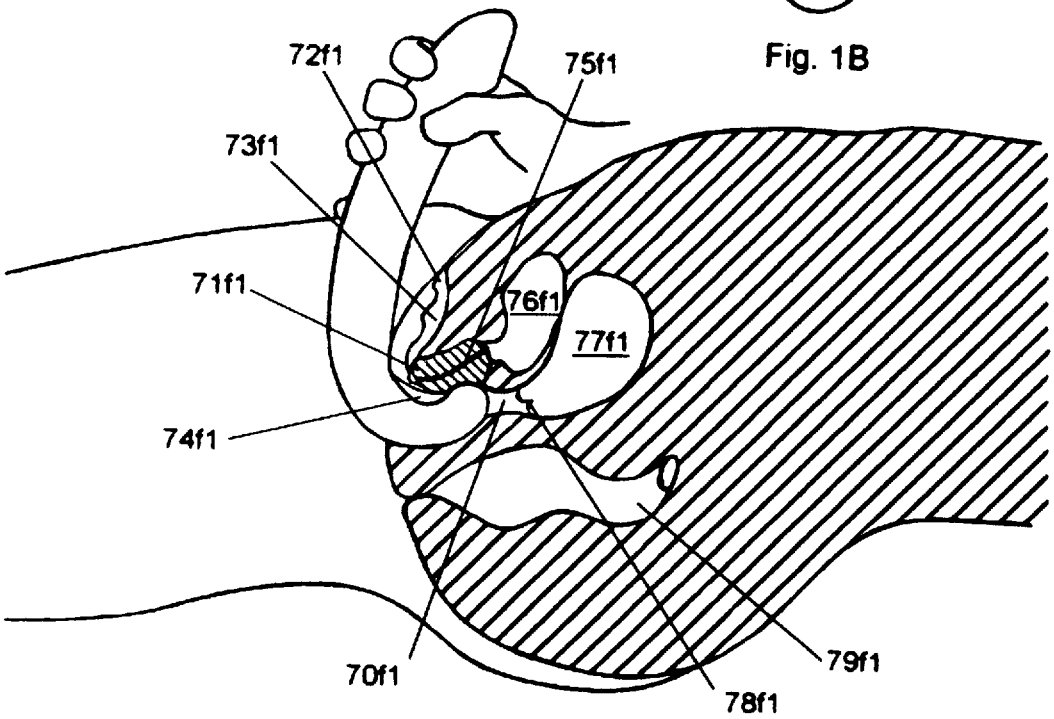

FIG. 5 is a lateral view of the glandular stimulator of FIG. 1 inserted as intended for use in the vagina.

Figure 6:
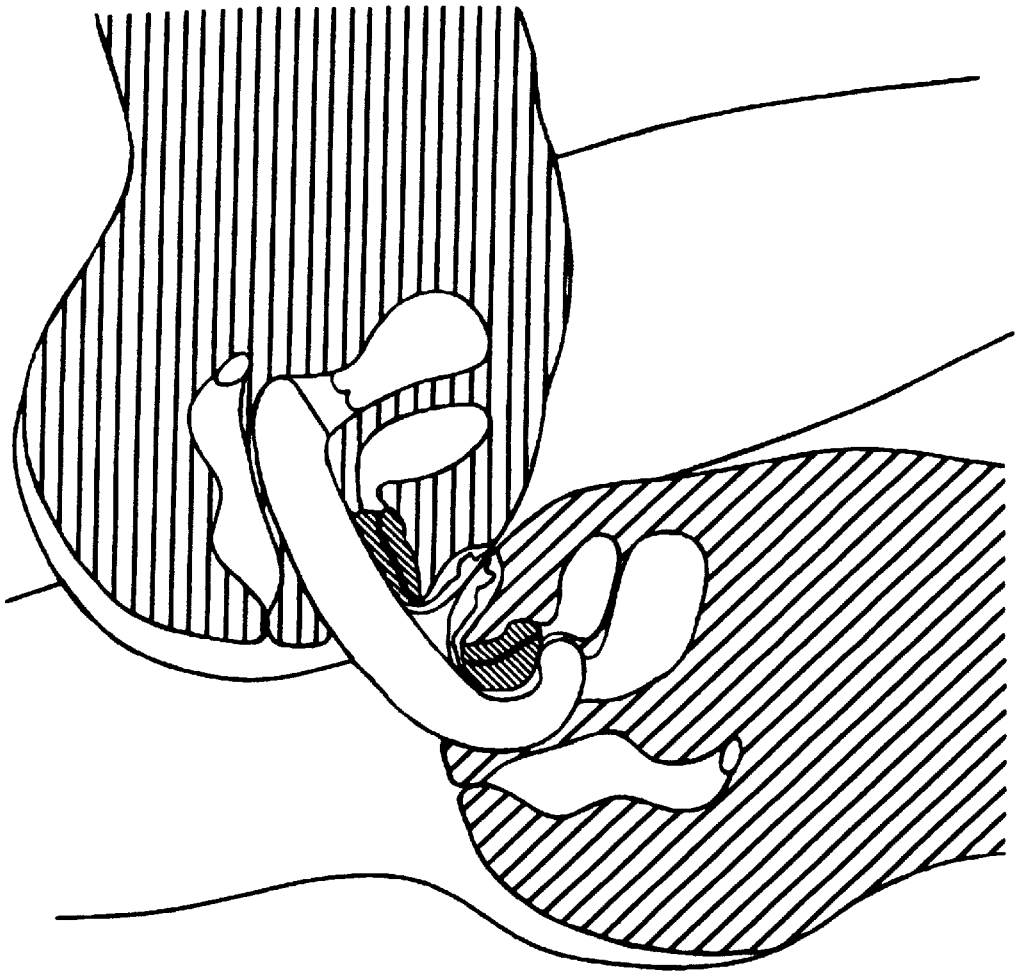

FIG. 6 is a lateral view of the preferred embodiment of FIG. 1 in use in the vaginal stimulation of a partner.

Figure 7:
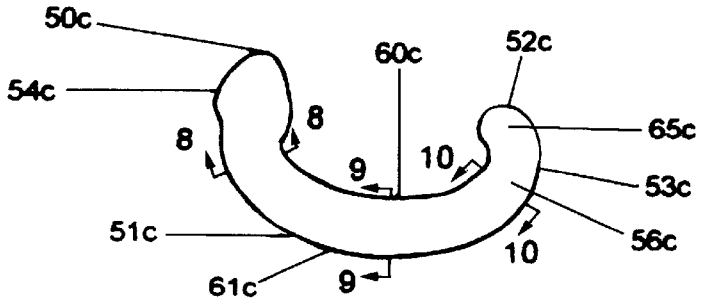

FIG. 7 is a lateral view of a C-shaped alternative embodiment of the glandular stimulator.

Figure 8:
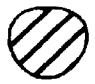
Figure 9:
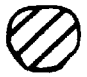
Figure 10:
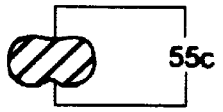

FIGS. 8, 9, and 10 are cross-sectional views of the C-shaped version of the glandular stimulator.

Figure 11:
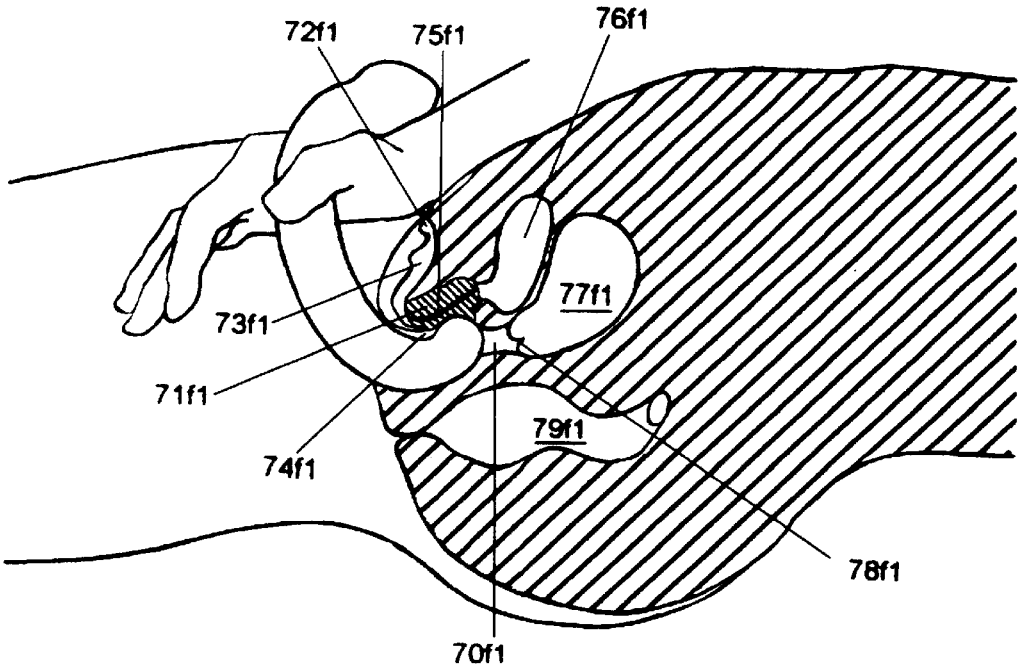

FIG. 11 is a lateral view of the C-shaped embodiment being manipulated by the wearer.

Figure 12:
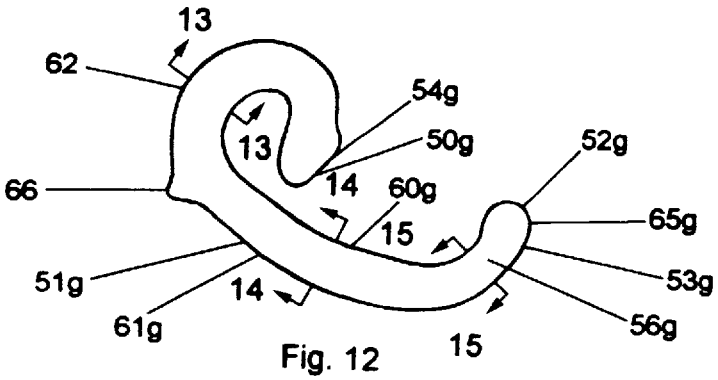

FIG. 12 is a lateral view of a G-shaped alternative embodiment of the glandular stimulator.

Figure 13:
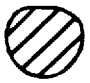
Figure 14:
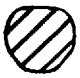
Figure 15:
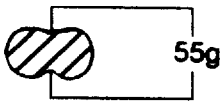

FIGS. 13, 14 and 15 are cross-sectional views of the G-shaped version of the glandular stimulator.

Figure 16:
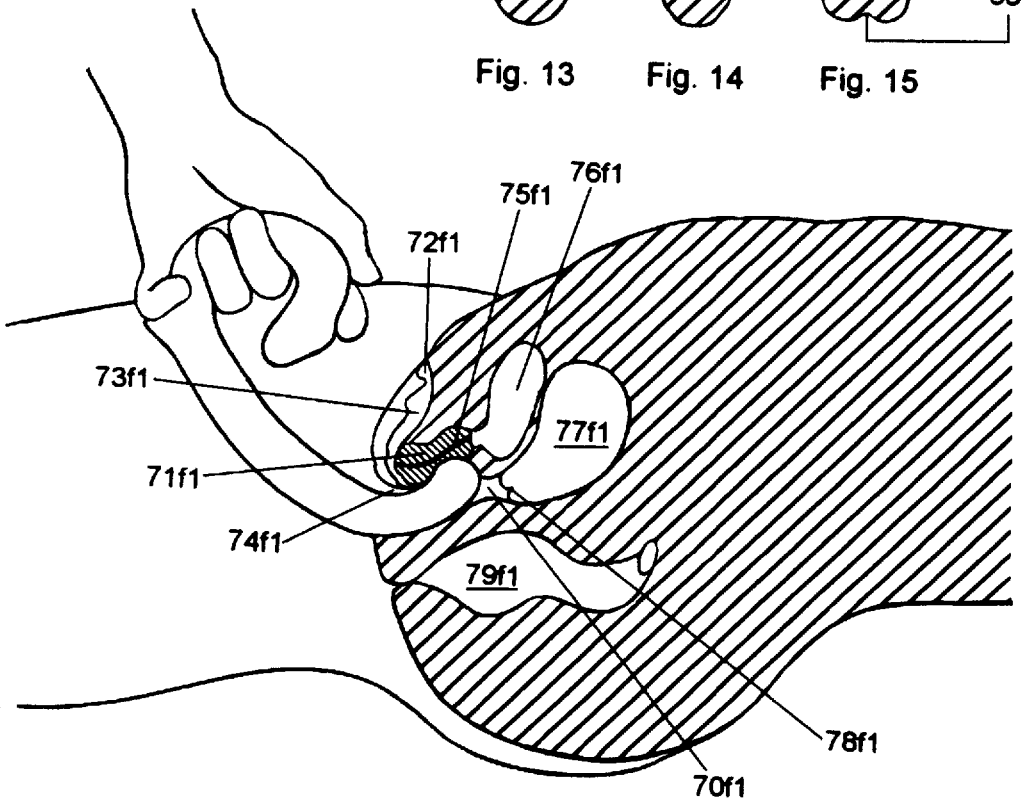

FIG. 16 is a lateral view of the G-shaped version being manipulated by a second person.

Figure 17:
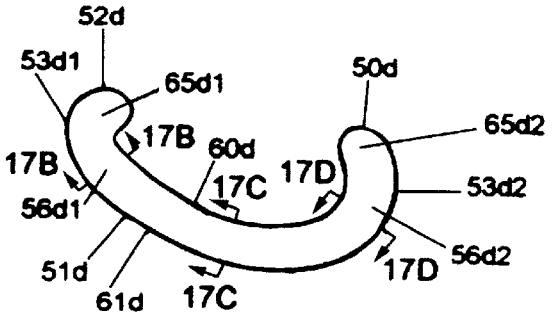

FIG. 17 is a lateral view of the double-anchored alternative embodiment of the glandular stimulator.

Figure 17B:
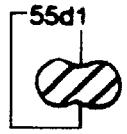
Figure 17C:
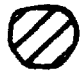
Figure 17D:
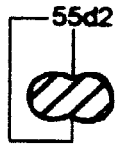

FIGS. 17B, 17C, and 17D are cross-sectional views of the double-anchored alternative embodiment of the glandular stimulator.

Figure 18:
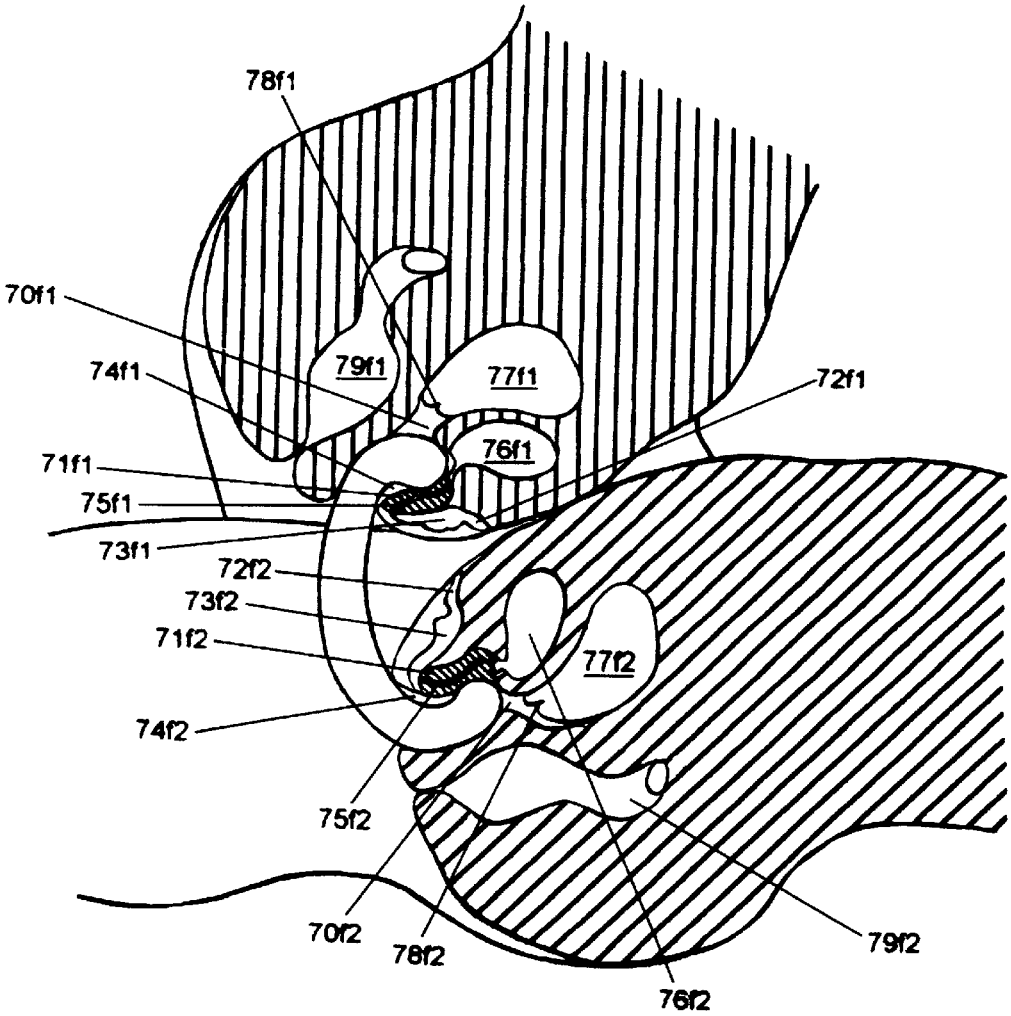

FIG. 18 is a lateral view of the double-anchor alternative embodiment of the stimulator in use.

Figure 19:
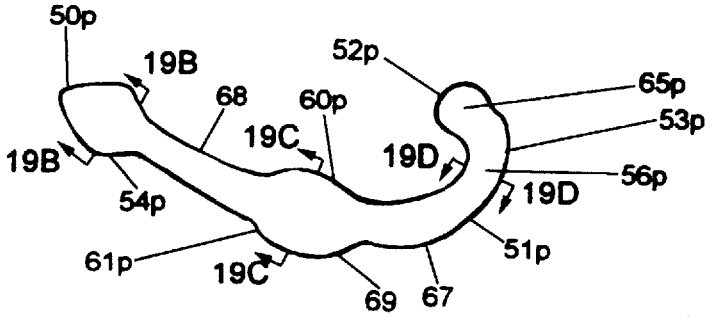

FIG. 19 is a lateral view of the prostate-stimulating alternative embodiment of the stimulator.

Figure 19B:
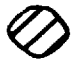
Figure 19C:
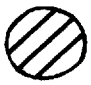
Figure 19D:
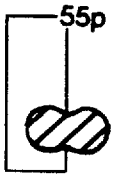

FIGS. 19B, 19C, and 19D are cross-sectional views of the prostate-stimulating alternative embodiment of the glandular stimulator.

Figure 20:
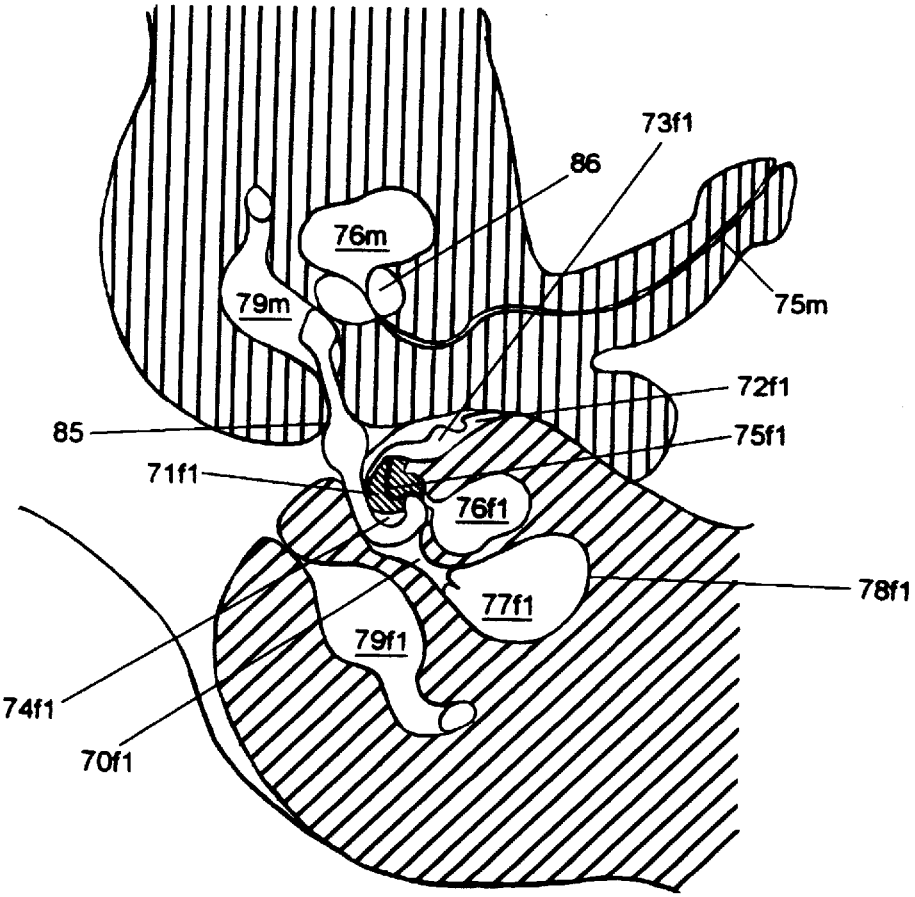

FIG. 20 is a lateral view of the prostate-stimulating alternative embodiment of the stimulator in use with the male partner ascendant.

Figure 21:
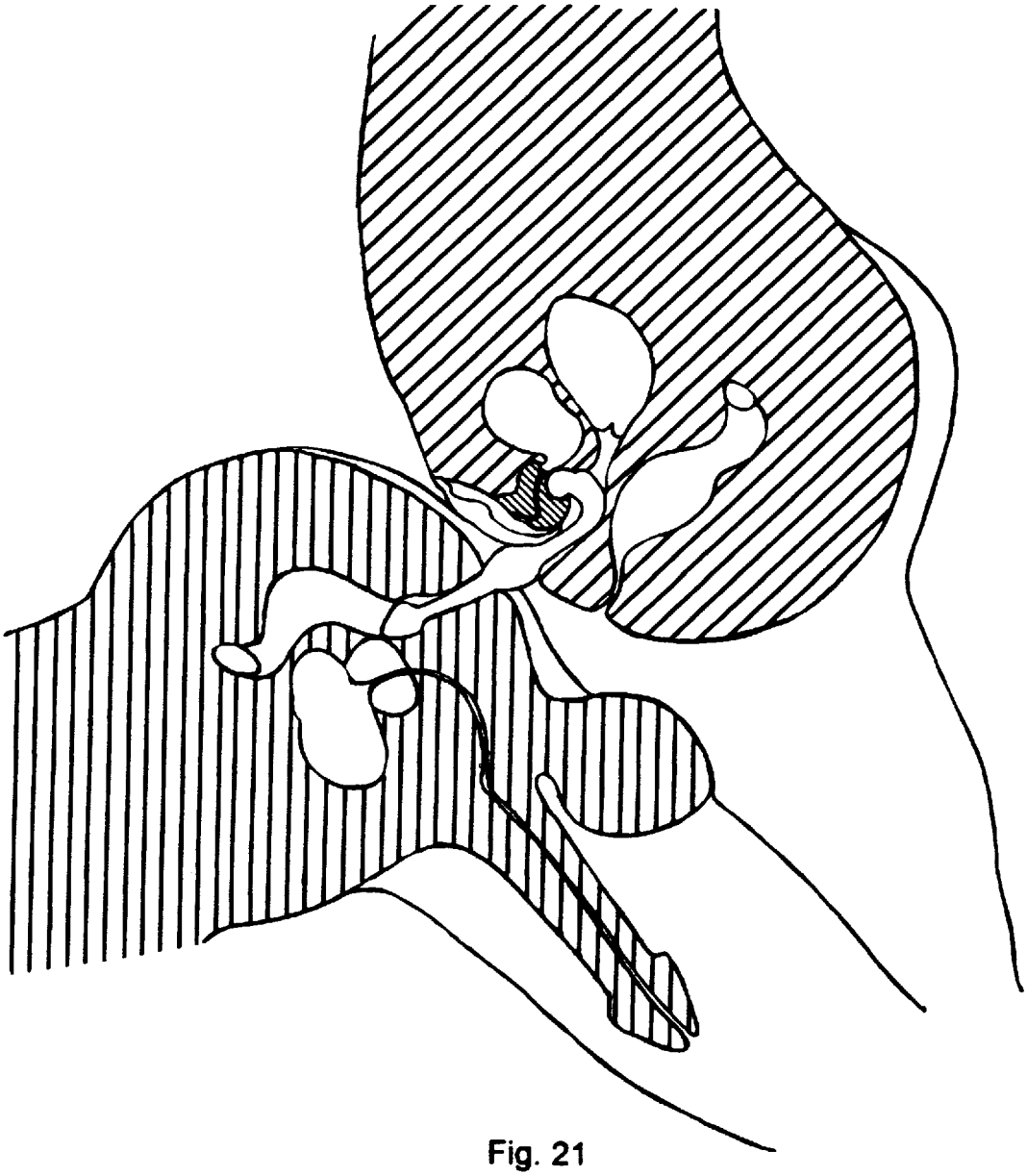

FIG. 21 is a lateral view of the prostate-stimulating alternative embodiment of the stimulator in use with the female partner ascendant.

Figure 22:
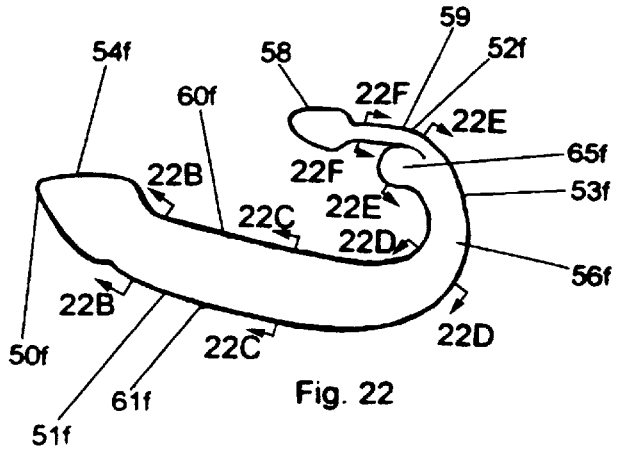

FIG. 22 is a lateral view of the forked alternative embodiment of the stimulator.

Figure 22B:
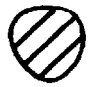
Figure 22C:
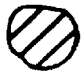
Figure 22D:
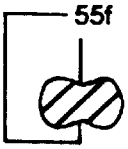
Figure 22E:
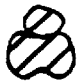
Figure 22F:
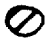

FIGS. 22B, 22C, and 22D are cross-sectional views of the forked embodiment of the stimulator of FIG. 22.

Figure 23:
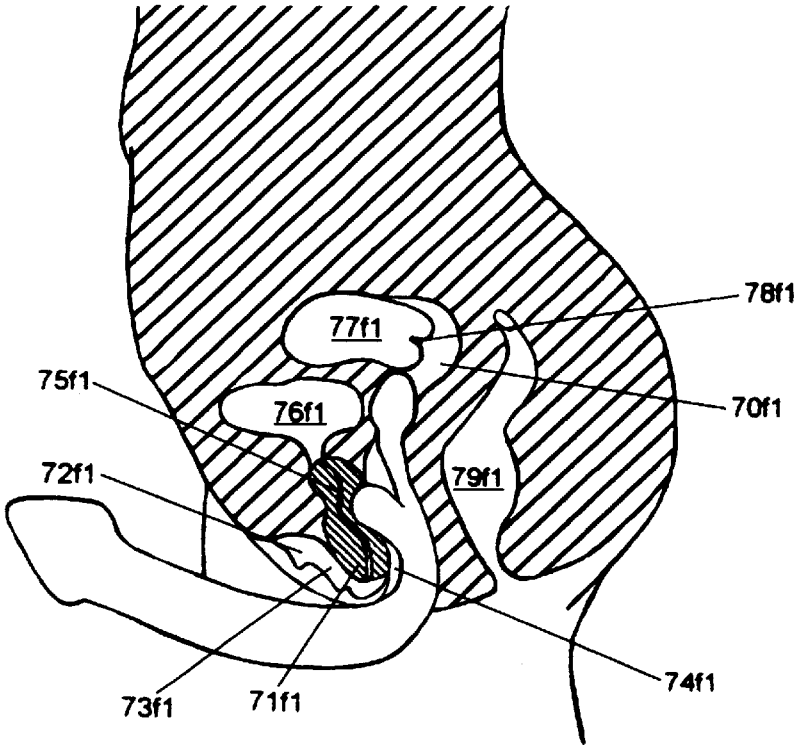

FIG. 23 is a lateral view of the forked alternative embodiment of the stimulator inserted as intended for use in the vagina.

LIST OF REFERENCE NUMERALS IN DRAWINGS

50*j*Distal end of J-shaped preferred embodiment
50*c*Distal end of C-shaped alternative embodiment
50*g*Distal e nd of G-shaped alternative embodiment
50*d*Distal end of double-anch ored alte rnative embodiment , with respect to first partner
50*p*Distal end of prostate-stimulating alternative embodiment
50*f*Distal end of forked alternative embodiment
51*j*Middle section of J-shaped preferred embodiment
51*c*Middle section of C-shaped alternative embodiment
51*g*Middle section of G-shaped alternative embodiment
51*d*Middle section of double-anchored alternative embodiment
51*p*Middle section of prostate-stimulating alternative embodiment
51*f*Middle section of forked alternative embodiment
52*j*Proximal end of preferred embodiment
52*c*Proximal end of C-shaped alternative embodiment
52*g*Proximal end of G-shaped alternative embodiment
52*d*Proximal end of double-anchored alternative embodiment, with respect to first partner
52*p*Proximal end of prostate stimulating alternative embodiment
52*f*Proximal end of forked alternative embodiment
53*j*Embedding hook of proximal end of preferred embodiment
53*c*Embedding hook of proximal end of C-shaped alternative embodiment
53*g*Embedding hook of proximal end of G-shaped alternative embodiment
53*d*1 Embedding hook of proximal end of double-anchored alternative embodiment
53*d*2 Embedding hook of distal end of double-anchored alternative embodiment
53*p*Embedding hook of proximal end of prostate-stimulating alternative embodiment
53*f*Embedding hook of proximal end of forked alternative embodiment
54*j*Knob of distal end of preferred embodiment
54*c*Knob of distal end of C-shaped alternative embodiment
54*g*Knob of distal end of G-shaped alternative embodiment
54*p*Lozenge of distal end of prostate-stimulating alternative embodiment
54*f*Knob of distal end of forked alternative embodiment
55*j*Groove of embedding hook of preferred embodiment
55*g*Groove of embedding hook of G-shaped alternative embodiment
55*c*Groove of embedding hook of C-shaped alternative embodiment
55*d*1 Groove of embedding hook of proximal end of double-anchored alternative embodiment
55*d*2 Groove of embedding hook of distal end of double-anchored alternative embodiment
55*p*Groove of embedding hook of prostate-stimulating alternative embodiment
55*f*Groove of embedding hook of forked altern ative embodiment
56*j*Flare of embedding hook of preferred embodiment
56*c*Flare of embedding hook of C-shaped alternative embodiment
56*g*Flare of embedding hook of G-shaped embodiment
56*d*1 Flare of embedding hook of proximal end of double-anchored embodiment
56*d*2 Flare of embedding hook of distal end of double-anchored embodiment
56*p*Flare of embedding hook of prostate-stimulating embodiment
56*f*Flare of embedding hook of forked alternative embodiment
58 Auxiliary knob of proximal end of forked alternative embodiment
59 Shaft of auxiliary knob of proximal end of forked alternative embodiment
60*j*Top side of preferred embodiment
60*c*Top side of C-shaped alternative embodiment
60*g*Top side of G-shaped alternative embodiment
60*d*Top side of double-anchored alternative embodiment
60*p*Top side of prostate-stimulating alternative embodiment
60*f*Top side of forked alternative embodiment
61*j*Bottom side of preferred embodiment
61*c*Bottom side of C-shaped alternative embodiment
61*g*Bottom side of G-shaped alternative embodiment
61*d*Bottom side of double-anchored alternative embodiment
61*p*Bottom side of prostate-stimulating alternative embodiment
61*f*Bottom side of forked alternative embodiment
62 Recumbent section of G-shaped alternative embodiment
65*j*Bulbous portion of proximal end of preferred embodiment
65*c*Bulbous portion of proximal end of C-shaped alternative embodiment
65*g*Bulbous portion of the proximal end of G-shaped alternative embodiment
65*d*1 Bulbous portion of the proximal end of double-anchored alte rnative embodiment
65*d*2 Bulbous portion of the distal end of double-anchored alternative embodiment
65*p*Bulbous portion of proximal end of prostate-stimulating alternative embodiment
65*f*Bulbous portion of proximal end of forked alternative embodiment
66 Leveraging spur of G-shaped alternative embodiment
67 Shank of prostate-stimulating alternative embodiment

68 Neck of prostate-stimulating alternative embodiment
69 Medial bulge of prostate-stimulating embodiment
**70*f*1** Vagina of first partner
**70*f*2** Vagina of second partner
**71*f*1** Grafenberg spot, or G spot (also described as the paraurethral sponge) of first female partner
**71*f*2** Grafenberg spot, or G spot (also described as the paraurethral sponge) of second female partner
**72*f*1** Glans clitoris of first female partner
**72*f*2** Glans clitoris of second female partner
**73*f*1** Clitoral root of first female partner
**73*f*2** Clitoral root of second female partner
**74*f*1** Vaginal subcavity of first female partner
**74*f*2** Vaginal subcavity of second female partner
**75*f*1** Urethra of first female partner
**75*f*2** Urethra of second female partner
**75*m*** Urethra of male partner
**76*f*1** Bladder of first female partner
**76*f*2** Bladder of second female partner
**76*m*** Bladder of male partner
**77*f*1** Uterus of first female partner
**77*f*2** Uterus of second female partner
**78*f*1** Cervix of first female partner
**78*f*2** Cervix of second female partner
**79*f*1** Rectum of first female partner
**79*f*2** Rectum of second female partner
**79*m*** Rectum of male partner
85 Anal sphincter of male partner
86 Prostate gland of male partner

SUMMARY

In accordance with the present invention, a glandular stimulator comprises an approximately cylindrical shaft with an embedding hook or anchor on the proximal end, which shaft and hook may be easily inserted into the vagina and which hook secures into a subcavity of the vagina upon insertion. The device may thus be anchored in the wearer's vagina without the need for an external strap or harness. The distal end may be grasped and manipulated by the wearer; used as a dildo and inserted into a partner's anus or vagina; or shaped similarly to the proximal end to be inserted and anchored in a partner's vagina. In the case of a male partner, the distal end may be shaped to optimally contact and stimulate the prostate gland. The intended result of the stimulator is sexual pleasure for the wearer and her partner.

DESCRIPTION OF GLANDULAR STIMULATOR

Preferred Embodiment: J-shaped (FIGS. 1,1B,2,3,4,5,6)

As shown in FIG. 1, the glandular stimulator of the preferred embodiment of the invention comprises a dildo, shaft, cylinder, or elongated member having a distal end **50*j* (left end as depicted) and a proximal end 52*j* (right end as depicted). Both distal end 50*j* and proximal end 52*j* refer to general areas and not to specific component parts. The total length of the preferred embodiment of the glandular stimulator is about 21 cm. It is bilaterally symmetrical and comprises a slightly curved shaft or middle section 51*j* of 14 cm length. Proximal end 52*j*** must be of sufficient rigidity to resist bending and involuntary dislodgment; the remaining portions may be equally rigid, more rigid, or less rigid.

As shown in FIGS. 2 and 3, the cross sections of middle section **51*j* are substantially circular and have diameter of about 3 cm. The curve of middle section 51*j* and an embedding hook 53*j* terminating in proximal end 52*j* are inclined concavely with respect to a top side 60*j* of the stimulator, where top side 60*j* refers to the upper side of the stimulator between proximal end 52*j* and distal end 50*j* and not to a specific component part. Distal end 50*j* is located at the end pf a pointed head or knob 54*j***, similar to that of a glans penis, of 3.5 cm length and 4 cm maximum diameter.

Figure 1B:
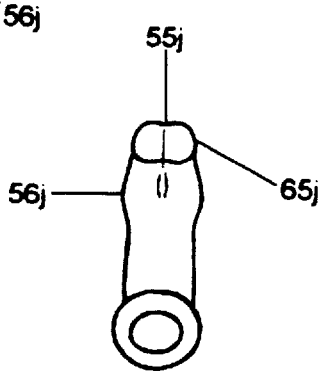
FIG. 1B is a perspective view from above of the glandular stimulator of FIG. 1.

As shown in FIGS. 1 and 1B, proximal end **52*j*is at the end of embedding hook 53*j* and terminates in a rounded or bulbous portion 65*j*. Bulbous portion 65*j* is partially bisected by a groove 55*j*. Groove 55*j* extends 5 cm on top side 60*j*, and continues another 7 cm on a bottom side 61*j*. Bottom side 61*j* refers to the lower side of the stimulator between proximal end 52*j* and distal end 50*j* and not to a specific component part. Embedding hook 53*j* curves up and slightly back towards distal end 50*j*, thus being slightly recumbent towards top side 60*j*. As shown in FIGS. 1B and 4, middle section 51*j* and embedding hook 53*j* are connected by a lateral flare section 56*j*, i.e., it is both wider (4.2 cm) and shorter (2.2 cm) than middle section 51*j***.

Preferred materials for the manufacture of the stimulator include polyurea and surgical-grade silicone. Such materials may be purchased from supply houses such as Douglas & Sturgess in San Francisco, Calif., and from similar sources.

The preferred method of manufacture is as follows:

First, a pattern (not shown) is made of red wax, or of any material that is compatible with (i.e., will not bond with) the mold material, which is preferred to be silicone. This pattern or mold plug has the shape of the stimulator of FIG. 1 and is carved in a conventional manner.

Next, a box (not shown) is provided with dimensions roughly 20 cm ×20 cm ×30 cm, enclosed on five sides and open at one of the 20 cm ×20 cm ends. The box is cut in half along the long axis with the cut bisecting opposing 20 cm ×30 cm sides, resulting in two 10 cm ×20 cm ×30 cm four-sided boxes, both open at the same top end.

An air stem is attached at the tip of distal end **50*j*, and two air stems at the tips of both lobes of bulbous portion 65*j*. All three stems (not shown) should extend distally in line with the axis of the stimulator and beyond distal end 50*j***.

Attach a pour spout to one side of flare of embedding hook **56*j***, and extend it axially as was done with the air stems.

Using a toothpick-sized stick, distal end **50*j*** is impaled and suspended with supports inside the two conjoined boxes, which boxes are sandwiched and bound securely together with the open sides upwards.

To create a mold, mold-making silicone is poured into the box to the open top. It is allowed to cure eight hours before removing the two halves of the box from the mold.

The mold is cut towards bottom side **61*j* of the pattern from distal end 50*j* to proximal end 52*j***, as long as is necessary to allow peeling back of the side of the mold to permit removal of the pattern from the mold.

The mold is inspected and cleaned. The cut is carefully closed and the mold is bound wihin the two box halves. The cavity is filled with water through the pour stem, and the water volume used is measured. After thus determining the volume of the pour, the water is drained, the apparatus is dismantled, allowed to dry, and the cavity sprayed with a mold release agent.

The predetermined quantity of polyurea (or silicone) is poured to slightly overfill the mold. The apparatus is demolded in 24 hours, and any holes in the cast are filled with the same material and smoothed over. The extraneous edges at the pour spout, air stems, and incised cut are cut and sanded if necessary. The finished stimulator is allowed to cure for seven days.

Manufacture of the alternative embodiments described below is similar to that of the preferred embodiment.

FIG. 5 illustrates the proper positioning of proximal end 50*j* of the stimulator of FIG. 1 in a vagina 70*f*1 of a wearer.

To emplace the stimulator from a lying (horizontal) position, the user lubricates the stimulator, spreads her legs slightly apart, grasps middle section 51*j* and places proximal end 52*j* of the stimulator at the vaginal entrance with distal end 50*j* pointing towards her navel. As the user presses proximal end 52*j* inward and upward, the orientation of middle section 51*j* shifts to follow the orientation of vagina 70*f*1. Emplacement of the stimulator thus follows a rolling motion with insertion.

Upon full insertion, embedding hook 53*j* is thereby lodged in a vaginal subcavity 74*f*1, adjacent to a Grafenberg or G spot 71*f*1 and to a clitoral root 73*f*1 . The elasticity of the vaginal walls allows insertion of proximal end 52*j* of the stimulator into the position shown. Once emplaced, the muscular vaginal walls easily hold the stimulator in place with embedding hook 53*j* pressing into G spot 71*f*1 . Flare of the embedding hook 56*j* aids in stabilizing the stimulator laterally in the vagina. To remove the stimulator the wearer must consciously relax her vaginal muscles and gently rotate distal end 50*j* of the stimulator up and out while grasping middle section 51*j* with her hand.

In use, the presently preferred embodiment as shown in FIG. 1 may be manually manipulated by grasping distal end 50*j* with the hand and gently tugging and releasing repeatedly, while the natural muscle tone of the vagina resists substantial movement of the stimulator. Embedding hook 53*j* thus stimulates G spot 71*f*1 specifically and the internal genitalia generally by alternately pressing upon and releasing pressure from G spot 71*f*1, as the stimulator is manipulated.

If distal end 50*j* is inserted into a partner's rectum 79*f*2 or a vagina 70*f*2 while proximal end 52*j* is positioned as above, the utility of distal end 50*j* is as that of any dildo; vaginal penetration is illustrated in FIG. 6. The wearer may stimulate herself and her partner simultaneously by undulating her hips and thrusting distal end 50*j* in and out of her partner's orifice. Distal end 50*j* thus provides sexual pleasure to the wearer's partner through thrusting and resultant friction. This motion simultaneously provides motion, pressure, and release of pressure of embedding hook 53*j* of proximal end 52*j* against the wearer's G spot 71*f*1 similar to that achieved through manual manipulation of distal end 50*j*.

When distal end 50*j* is inserted in vagina 70*f*2 of the wearer's partner, the stimulator serves to align the vaginas of the two women and control their motion with respect to each other. Hence, with deep penetration the vulvas of the two women come into contact. Therefore, in addition to the indirect clitoral stimulation created by the internal motion of vaginal thrusting and G spot pressure, this use of the stimulator facilitates direct stimulation of a glans clitoris 72*f*1 of the wearer and a glans clitoris 72*f*2 in the wearer's partner, and also of other sensitive external tissues such as the labia majora and labia minora by aligning and stabilizing the relative motions of the vulvas of the two women.

The glandular stimulator aligns the bodies of two female partners vagina-to-vagina, clitoris-to-clitoris, etc., which is unlike the positioning attained if one partner is wearing a strap-on pelvic-mounted dildo. In this latter case the wearer of the strap-on dildo aligns her mons pubis (the area just above the clitoris) with her partner's vagina, and the wearer thus has no direct vaginal or G spot stimulation. The positioning attained by the glandular stimulator is more similar to that of a double-ended dildo (see Prior Art, above). However, it is difficult to move a double-ended dildo when the partners'bodies are in close contact. The glandular stimulator obviates this difficulty by remaining securely anchored in the vagina of one woman, the wearer. The relative motion of either woman's pelvis then produces G spot pressure in the wearer and vaginal thrusting in the partner of the wearer.

As in the above case in which the wearer's partner is vaginally penetrated, the two may engage in face-to-face sex. Alternatively, the partner may prefer to be vaginally entered from another position, e.g., from behind. Such positions may be pleasant alternatives but have the disadvantage of eliminating the full vulva-to-vulva contact described immediately above. A similar situation applies to anal penetration of a partner (it is then immaterial whether the partner is male or female).

Alternative Embodiment: C-Shaped (FIGS. 7, 8, 9, 10, 11)

FIG. 7 depicts an alternative embodiment of the stimulator, differing mainly from FIG. 1 in the relative sharpness of the upward curve of a middle section 51*c* as it approaches a distal end 50*c,* and in overall length which is 16 cm. This alternative embodiment is therefore described as C-shaped. As shown in FIGS. 8, 9, and 10, cross-sectional dimensions and proportions through middle section 51*c* and a flared portion 56*c* of an embedding hook 53*c* are similar to those of the preferred embodiment of FIG. 1. A groove of embedding hook 55*c* and a bulbous portion of the proximal end 65*c* are also as in the preferred embodiment. A knob of distal end 54*c* is also similar to that of the preferred embodiment. Distal end 50*c,* a proximal end 52*c,* a top side 60*c* and a bottom side 61*c* refer to general areas and not to specific component parts.

The more strongly curved middle section 51*c,* compared to that of the preferred embodiment, facilitates grasping by the wearer's hand as shown in FIG. 11. This palms-down orientation is ergonomically correct and allows easy self-manipulation of the stimulator.

Alternative Embodiment: G-Shaped (FIGS. 12, 13, 14, 15, 16)

FIG. 12 depicts a second alternative embodiment of the stimulator, described as G-shaped because of the strong recumbent angle of a distal end 50*g* onto a top side 60*g*. As shown in FIGS. 13, 14, and 15, cross-sectional dimensions and proportions through a middle section 51*g* and a flared portion 56*g* of an embedding hook 53*g* of a proximal end 52*g* are similar to those of the preferred embodiment of FIG. 1. A groove of embedding hook 55*g* and a bulbous portion of the proximal end 65 are also as in the preferred embodiment.

Middle section 51*g* is 12 cm in length and terminates at a leveraging spur 66 on a bottom side 61*g*. The portion from leveraging spur 66 to distal end 50*g* is a recumbent section 62. Distal end 50*g* terminates in a glans-penis shaped knob 54*g*. The overall length of this embodiment is 18 cm and its height is 9.5 cm. The distance from distal end 50*g* to a proximal end 52*g* is 8 cm. 1. Distal end 50*g,* proximal end 52*g,* top side 60*g*and bottom side 61*g* refer to general areas and not to specific component parts.

FIG. 16 shows this embodiment being manipulated by a partner's hand. Note the small finger poised upon leveraging spur 66, which facilitates slight lateral manipulation of the stimulator.

Embedding hook 53*g* is less strongly curved than that of the preferred embodiment. This is necessary to allow insertion due to possible interference from recumbent section 62. The gentler angle of embedding hook 53*g* can be enhanced by an inward-and-upward motion of the partner's hand (counter-clockwise as shown in the diagram), thus achieving high angle stimulation of G spot 71*f*1. This gentler angle of embedding hook 53*g* also permits deeper penetration of vagina 70*f*1. With deeper penetration knob of distal end 54*g* comes into contact with the wearer's external genitalia, thus enhancing pleasure. The wearer's partner may choose to alternate the inward-and-upward motion with more linear thrusting deeper into the vagina. Hence this alternative embodiment suggests a variation in use from that of the preferred embodiment.

Alternative Embodiment: Double-Anchored (FIGS. 17, 17B, 17C, 17D, 18)

FIG. 17 depicts an embodiment of the invention having a middle section 51*d,* a proximal end 52*d,* an embedding hook (on the proximal end) 53*d*1 , a distal end 50*d,* and an embedding hook (on the distal end) 53*d*2. Embedding hook 53*d*1 has a groove 55*d*1 and a bulbous portion 65*d*1 and embedding hook 53*d*2 has a groove 55*d*2 and a bulbous portion 65*d*2 equivalent to those of the preferred embodiment. A top side 60*d,* a bottom side 61*d,* distal end 50*d* and proximal end 52*d* all refer to general areas and not to component parts. Embedding hook of the proximal end 53*d*1 is more tightly curved onto top side 60*d* than is embedding hook of the distal end 53*d*2. The overall length of this embodiment is 26 cm.

FIG. 18 shows the double-anchored alternative embodiment in use. The first partner inserts proximal end 52*d* into her vagina 70*f*1, using the rotating method described for the preferred embodiment, to anchor embedding hook of proximal end 53*d*1 in her vaginal subcavity 74*f*1. It may be necessary to straighten middle section 5l*d* during insertion to avoid interference of distal end 50*d* with the first partner's body. Similarly, distal end 50*d* may be manually straightened while inserted into vagina 7O*f*2 of the second partner and lodging distal end 50*d* in a vaginal subcavity 74*f*2 of the second partner. With both ends emplaced, the vulvas of the two women are aligned, including glans clitoris 72*f*1 of the first partner with glans clitoris 72*f*2 of the second partner.

Thus, the G spots of the two women are stimulated simultaneously.

FIG. 18 also illustrates the relative positioning with use of this embodiment by two women. Note the following anatomical parts: a G spot of the second partner 71*f*2, the clitoral root of the second partner 73*f*2, the urethra of the first partner 75*f*1, the urethra of the second partner 75*f*2, the bladder of the first partner 76*f*1, the bladder of the second partner 76*f*2, the uterus of the first partner 77*f*1, the uterus of the second partner 77*f* 2, the cervix of the first partner 78*f*1, the cervix of the second partner 78*f*2, and the rectum of the first partner 79*f*1.

Alternative Embodiment: Prostate-Stimulating (FIGS. 19, 19B, 19C, 19D, 20, 21)

FIG. 19 depicts an embodiment having a proximal end 52*p* and an embedding hook 53*p,* both of dimensions equivalent to those of the preferred embodiment. Embedding hook 53*p* has a groove 55*p,* a flare 56*p,* and a bulbous portion 65*p* similar to those of the preferred embodiment. A middle section 51*p* is 19 cm in length and comprises a narrowed section or neck 68, a medial bulge 69, and a shank 67. A distal end 50*p* terminates in a diamond-shaped knob or lozenge head 54*p*. Medial bulge 69 joins distal end 50*p* to middle section 51*p*. This embodiment is substantially straight from medial bulge 69 through distal end 50*p*. Proximal end 53*p,* distal end 50*p,* a top side 60*p* and a bottom side 61*p* all refer to general areas and not to component parts. The overall length of this embodiment is 26 cm.

FIG. 20 shows this embodiment in use. Proximal end 53*p* is emplaced in vagina 70*f*1 of the female partner in a manner identical to that used to emplace the preferred embodiment. Using suitable lubrication, distal end 50*p* is inserted slowly past an anal sphincter 85 into a rectum 79*m* of a male partner. Lozenge head 54*p* of distal end 50*p* thus contacts a prostate gland 86 of the male partner which surrounds a urethra 75*m*. As proximal end 53*p* is anchored in the female partner's vaginal subcavity 74*f*1, pelvic thrusting on her part results in relative motion between lozenge head 54*p* and a prostate gland 86 of her partner.

Alternative Embodiment: Forked (FIGS. 22, 22B, 22C, 22D, 22E, 22F, 23)

FIG. 22 shows an alternative embodiment which is similar to the preferred embodiment, but with the addition of elements at a proximal end 52*f*. An auxiliary knob 58 connects to a shaft 59, and shaft 59 joins a bottom side 61*f* such that proximal end 52*f* bifurcates into shaft 59 and an embedding hook 53*f*. FIGS. 22B, 22C, and 22D are cross-sectional views through the embodiment. Specifically, 22E is a cross-sectional view through embedding hook 53*f* and shaft 59. As is the case for all embodiments, the material such as silicone of which the stimulator is made is of a stiffness such that embedding hook 53*f* cannot be easily bent by internal muscular contraction, thus allowing embedding hook 53*f* to serve as an effective anchor, shaft 59 is of sufficient thinness that the angle formed where shaft 59 joins embedding hook 53*f* is easily widened or narrowed with pressure against shaft 59.

FIG. 23 shows the forked embodiment emplaced in vagina 70*f*1 of a wearer. The method for emplacement is as that for the preferred embodiment, except that auxiliary knob 58 and shaft 59 must be bent toward embedding hook 53*f* as the entirety of proximal end 52*f* is inserted. As embedding hook 53*f* reaches vaginal subcavity 74*f*1, shaft 59 has room to straighten slightly and shaft 59 and auxiliary knob 58 extend further into vagina 70*f*1. This embodiment has the advantage of providing additional deep vaginal fullness and pressure in addition to the G spot pressure and stimulation of embedding hook 53*f*.

Advantages experienced by users of the glandular stimulator include: 1) ease and quickness in emplacing the device, as there are no mechanical items such as buckles or straps to be manipulated; 2) ease of use of the device, as there are no unfamiliar techniques or motions to be learned, and the hands are left free; 3) mutual and simultaneous pleasure for both partners; 4) avoidance of overtly male-imitative imagery, as the stimulator is worn extending from the vagina by the (female) wearer, and not extending from the mons pubis like a conventional pelvicmounted dildo or a penis; 5) toning of pelvic muscles and resultant enhanced sexual response and pleasure.

CONCLUSIONS, RAMIFICATIONS, AND SCOPE

Thus the reader will see that the glandular stimulator provides sexually active women with a new, highly effective, and easy-to-use means of engaging in sexual activity with a male or female partner. The stimulator is easy to insert in a wearer's vagina, is self-anchoring, and simultaneously very directly stimulates her G spot and indirectly stimulates her other internal sexual organs while permitting her to either engage in sexual activity with a partner or stimulate her external genitalia by other means. That sexual activity includes vaginal penetration with or without direct G-spot stimulation of her partner, and anal penetration where, in the case of a male partner, his prostate gland may be effectively stimulated.

While the above description contains many specificities, these should not be construed as limitations on the scope of the invention, but rather as an exemplification of one preferred embodiment thereof. Many other variations are possible. For example, variations of the distal end include providing means for attachment to a mechanical device to move or vibrate the stimulator, or the incorporation of unusual shapes (such as ridges or coaxial grooves), dimensions or textures to enhance the pleasure of a partner upon penetration. The distal end can also be modified to be equivalent to the proximal end (including that variation of the proximal end which is forked into an anchor-plus-dildo), in which case this embodiment would be intended to provide G spot stimulation, vaginal stimulation, and vulva-to-vulva contact for two women. All these variations permit a different range of utility for the distal end than is available from the preferred embodiment. Other variations include larger and smaller dimensions than those given for the preferred embodiment, and small variations from the angles between parts as described above, in order to accommodate women of differing sizes and the differing sizes of partners of these women. In particular the specific shape and size of the two knobs and flare of the proximal end may be increased, decreased or merged. The glandular stimulator may be made of a wide range of materials which vary in terms of their flexibility, visual appeal, porosity, ease of cleaning, time in adjusting to body temperature, color, electrical conductivity, and so on.

Accordingly, the scope of the invention should be determined not by the embodiments illustrated, but by the appended claims and their legal equivalents.

I claim:

1. A device for inserting into a subcavity of a woman's vagina to stimulate the Grafenberg spot therein, comprising:

an elongated, generally cylindrical shaft having first and second rounded ends, a distal end portion beginning at said first rounded end and terminating at a flared section and a proximal end portion beginning at said flared section and terminating at said second rounded end;

said distal end portion having a predetermined length and adapted to have said first rounded end extend from said vagina subcavity a sufficient distance either for self grasping by the wearer or for use with a partner;

said flared section and said proximal end portion bent to form an embedding hook having a J shape with said second rounded end being recumbent with respect to said distal end portion;

said proximal end portion being constructed of sufficiently rigid material so as to minimize bending and involuntary dislodgment by said wearer's internal musculature when said proximal end portion is inserted;

said proximal end portion further having a predetermined size and a configuration so that said second rounded end is adapted to contact said Grafenberg spot within said subcavity of a woman's vagina and applies pressure to the Grafenberg spot at approximately 90° to the axis of the vaginal canal;

whereby when inserting said proximal end portion into said subcavity of a woman's vagina, stimulation of said Grafenberg spot is effected by said second rounded end with movement of said distal end portion by said wearer or a partner of said wearer.

2. The device of claim 1 wherein said distal end portion first rounded end of said shaft terminates in a rounded knob, said knob and a portion of said shaft adapted to be of length and proportion sufficient to extend into the anal or vagina cavity of said wearer's sexual partner when said wearer and said partner are positioned adjacent each other.

3. The device of claim 1 wherein said distal end portion of said shaft is of a length and proportion adapted to extend into the anal or vagina cavity of said wearer's sexual partner when said wearer and said partner are positioned adjacent each other.

4. The device of claim 1 wherein said material comprises: material selected from the group consisting of wood, metal, plastic, rubber, wax, glass, and composite materials.

5. The device of claim 1 wherein said shaft is of a length adapted to protrude substantially from said wearer's vaginal opening when said hooked configuration presses against said wearer's Grafenberg spot, said distal end of said shaft curving through at least one hundred eighty degrees in the same plane as and on an upper side of said shaft; whereby said distal end is adapted to contact with said wearer's external genitalia, and whereby said wearer or said wearer's sexual partner may grasp said distal end and manipulate said shaft so that proximal end will stimulate said wearer's Grafenberg spot and said distal end will stimulate said external genitalia.

6. A method for stimulating the Grafenberg spot of a woman, comprising:

a) emplacing a shaft in which a proximal end is constructed of sufficiently rigid material to minimize bending in a vagina of said woman, said shaft having at its proximal end a hooked member attached at an apprpriately right angle to a distal end of said shaft so that a tip thereof curls back towards said distal end, said hooked member being of a size so that together with said rigidity is sufficient to embed into a subcavity of said vagina, said subcavity being adjacent to said woman's Grafenberg spot to which said curled back hooked member tip contacts, and b) manipulating said shaft by either a wearer or by a sexual partner of said wearer by grasping and moving said shaft at a point on said shaft external to said woman's vagina, whereby pressure and manipulation of said shaft and said attached hooked member results in pressing said Grafenberg spot at an angle of approximately 90° to the vaginal canal of said woman by said woman by said tip of said hooked member.

7. The method of laim 6 wherein the distal end of said shaft terminates in a rounded knob, said knob and a portion of said shaft being of length and proportion sufficient to fill the anal or vaginal cavity of said wearer's sexual partner.

8. The method of claim 6 wherein said material of said shaft comprises: material selected from the group consisting of wood, metal, plastic, rubber, wax, glass and composite materials.

9. The method of claim 6 wherein said distal end of said shaft is of a length sufficient to protrude substantially from said wearer's vaginal opening, said shaft curving through approximately 270 degrees in the same plane as and on the same side of said shaft as said hooked member, whereby said distal end may rest in contact with said wearer's external genitalia, and whereby said wearer or said wearer's sexual partner may grasp said distal end and manipulate said hooked member interior to said wearer's vaginal cavity and said distal end against said wearer's said external genitalia.

10. A device for stimulating the Grafenberg spot of a woman, comprising:

a) a vaginal anchor, said anchor constructed of sufficiently rigid material to minimize bending and having a proximal end, said proximal end, said proximal end having a flared section and embedding hook adapted to be of dimensions to fit comfortably in a subcavity of a vagina of said woman adjacent to said woman's Grafenberg spot and adapted to apply pressure to the Grafenberg spot approximately 90° to the vagina canal, and b) a shaft, said shaft being connected to a distal end of said anchor, said shaft adapted to be of dimensions to fit comfortably in the posterior portion of said woman's vagina extending from said anchor, said shaft being of length sufficient to extend out of the vagina opening of said woman when said anchor is emplaced adjacent to said woman's Grafenberg spot, c) said shaft being adapted to be of a length sufficient to protrude substantially from a wearer's vagina opening when said tip of said curled end of said hooked portion presses against said wearer's Grafenberg spot, said shaft curving through approximately 270 degrees in the same plane as and on an upper side of said shaft; whereby said distal end rhythmically makes contact with said wearer's external genitalia, and whereby said wearer or said wearer's sexual partner may grasp said distal end and manipulate said shaft so that said proximal end will stimulate said wearer's Grafenberg spot and said distal end will stimulate said external genitalia.

11. A device of claim 10 wherein said material comprises: material selected from the group consisting of wood, metal, plastic, rubber, wax, glass and composite materials.

* * * * *